F6966 XR 4,039,374

United States Patent [19]

Deutsch et al.

[11] 4,039,374

[45] Aug. 2, 1977

[54] BLEACHING OF CELLULOSIC PULP FIBERS WITH CHLORINE DIOXIDE IN THE PRESENCE OF A VANADIUM COMPOUND

[75] Inventors: Howard Deutsch, Forsyth, Ga.; John D. Shoemaker, Jr., Trenton, N.J.

[73] Assignee: Union Camp Corporation, Wayne, N.J.

[21] Appl. No.: 609,039

[22] Filed: Aug. 29, 1975

[51] Int. Cl.[2] ..... D21C 9/14

[52] U.S. Cl. ..... 162/79; 8/108 A; 162/87

[58] Field of Search ..... 162/67, 79, 87, 88, 162/89; 8/108 R, 108 A

[56] References Cited

U.S. PATENT DOCUMENTS

| | | | |
|---|---|---|---|
| 2,166,330 | 7/1939 | Vincent | 162/87 X |
| 2,706,673 | 4/1955 | Burling et al. | 162/87 |
| 2,938,826 | 5/1960 | Marpillero | 162/87 |
| 2,975,169 | 3/1961 | Cranford et al. | 162/79 X |
| 3,433,702 | 3/1969 | Jack et al. | 162/87 |
| 3,501,374 | 3/1970 | Jack et al. | 8/108 X |

OTHER PUBLICATIONS

Pulp Bleaching with Sodium Chlorate, Rapson et al., TAPPI, vol. 42, No. 8, 8-1959, pp. 642-649, 162-187.

*Primary Examiner*—Arthur L. Corbin
*Attorney, Agent, or Firm*—Kane, Dalsimer, Kane, Sullivan and Kurucz

[57] ABSTRACT

Cellulosic pulp fibers are bleached with chlorine dioxide in the presence of a vanadium compound containing vanadium in the +4 or +5 oxidation state so as to attain a final pH of less than about 3.0 whereby brightness reversion of the resultant bleached pulp fibers is inhibited.

8 Claims, No Drawings

BLEACHING OF CELLULOSIC PULP FIBERS WITH CHLORINE DIOXIDE IN THE PRESENCE OF A VANADIUM COMPOUND

BACKGROUND OF THE INVENTION

1. Field of the Invention

The invention concerns a process for the delignification and bleaching of cellulosic fibers and more particularly concerns an improvement in the use of chlorine dioxide to bleach cellulose pulps.

2. Brief Description of the Prior Art

The delignification and bleaching of cellulosic pulps employing chlorine dioxide as the active agent is a well known procedure; see for example U.S Pat. Nos. 2,513,788; 3,345,250; 3,619,350; 3,720,577; German Pat. No. 413,338 (1925); and Monograph No. 27, Technical Association for the Pulp and Paper Industry, Chapter 8, (1963).

The use of vanadium containing compounds as catalysts to permit the bleaching of cellulose pulps with alkali metal chlorates and alkaline earth metal chlorates has been described prior to the invention; see for example U.S. Pat. Nos. 2,929,757; 2,938,826 and Rapson et al., TAPPI, 42, No. 8, August 1959, pages 642–649.

SUMMARY OF THE INVENTION

The invention comprises in a process for the delignification and bleaching of cellulosic fibers which includes a step of contacting said fibers with chlorine dioxide, the improvement which comprises; carrying out said step in the presence of a compound containing vanadium in the +4 or +5 oxidation state.

The process of the invention yields pulp of improved brightness for a given unit of chlorine dioxide.

DETAILED DESCRIPTION OF THE INVENTION

Methods and apparatus for delignifying and bleaching cellulose fibers with chlorine dioxide are so well known that they need not be described herein in detail; see for example U.S. Pat. Nos. 3,501,374; 3,619,350; and 3,652,387. In general, the chlorine dioxide gas is absorbed in cold water to obtain an aqueous solution containing up to 10 grams per liter of chlorine dioxide. This solution of chlorine dioxide is then admixed with a desired proportion of heated (from about 50° to about 90° C) pulp and held in an appropriate reaction vessel until the chlorine dioxide is reduced. During the bleaching with chlorine dioxide the pulp slurry is generally maintained at a pH of from about 2.0 to about 6.0. At the conclusion of the reaction the bleached pulp is washed with water to remove water soluble oxidation products.

Many variations may be employed in bleaching cellulosic fibers which chlorine dioxide. For example, the chlorine dioxide may be generated in situ within the pulp composition, admixing the gaseous chlorine dioxide directly with the pulp slurry. Another variation includes admixture of the chlorine dioxide with other oxidation agents such as chlorine. The bleaching process may be carried out in a wide variety of apparatus such as batch reactors and continuous bleaching tower reactors. Regardless of the variant method employed in bleaching cellulosic fibers with chlorine dioxide, it may be improved by the method of the present invention.

Similarly, many of the commercial cellulose fiber bleaching processes comprise the sequential treatment of the pulp with a number of different bleaching agents with intervening steps of caustic extraction and/or washing with water. Those sequential processes which employ at least one chlorine dioxide application step are improved by the method of this invention. The method of the invention is particularly advantageous for bleaching Kraft pulp with chlorine dioxide following initial treatments with chlorine and caustic.

The process of the invention is carried out by applying the chlorine dioxide bleaching agent in the presence of vanadium compounds or ions which may be generated from vanadyl salts, metavanadate salts or vanadium oxides. Representative of vanadium compounds which may be employed in the improved process of the invention are vanadium pentoxide, vanadyl trichloride, vanadyl sulfate and the like. Sodium vanadate is preferred. The source of vanadium may be added by first dispersing it in a partially delignified pulp prior to the application of the chlorine dioxide, or it may be added with mixing to the pulp at the same time that the chlorine dioxide is applied, or it may be added to the pulp after the addition of the chlorine dioxide so long as sufficient further reaction time is allowed after the addition of the vanadium to the mixture.

The proportion of vanadium employed is not critical, but generally will be within the range of from about 0.1 to about 2% by weight of the chlorine dioxide to be applied. Although larger proportions may be employed, it is generally not feasible on economic grounds. The preferred proportion of vanadium employed is within the range of from about 0.5 to about 1.0% by weight of the chlorine dioxide to be employed. The improved process of the invention is found to be advantageous when the step of contacting with chlorine dioxide is carried out so as to provide a final pH of 3.0 or less, for example a pH of from about 1.5 to about 2.5.

Although the process of the invention may be carried out at any temperature conventionally employed in the bleaching of cellulose pulps with chlorine dioxide, it is particularly advantageous when the step of contacting with chlorine dioxide is carried out at a temperature within the range of from about 70° C to about 80° C.

The period of time required for optimum delignification and bleaching to occur in the process of the invention will of course depend upon such variables as temperatiure, pH, weight of chlorine dioxide application and like variables employed for a given process. Generally, the reaction is completed satisfactorily within an hour (as is the case when vanadium compounds are not present). However, quite unexpectedly it has been found that unlike the prior art processes employing chlorine dioxide, wherein brightness diminishes with time after the chlorine dioxide has been consumed, the pulps bleached according to the process of the invention continue to increase in brightness for several hours. This is particularly advantageous when the pulp must be retained in bleach towers for unexpectedly long periods of time.

The following examples describe the manner and process of making and using the invention and set forth the best mode contemplated by the inventors of carrying out the invention, but are not to be construed as limiting. Unless otherwise stated, all proportions given are parts by weight. The various data relating to physical properties was derived as follows unless otherwise indicated.

The consistency of starting pulps was determined by drying a representative sample and determining the dry weight. The consistencies in the reaction mixtures were established by diluting the known consistency starting pulp with known amounts of diluents.

The permanganate numbers were determined by Tappi method T 214 su-71.

Brightness was measured with a GE brightness tester by Tappi method T 217 m-48.

EXAMPLE 1

A pine kraft pulp after chlorination and caustic extraction is washed to obtain a pulp having a permanganate number of 4.4. Six equal portions of this pulp are charged to six separate and appropriate reaction vessels. The mixtures are heated to circa 70° C. To each vessel there is added with stirring of the contents, 0.8% chlorine dioxide (based on the weight of pulp). The consistency after $C10_2$ addition was 10%.

After 1 hour reaction time varying amounts of sodium vanadate are added to vessels 2–6. At the same time 10 ml of 0.1N hydrochloric acid is added to these same vessels so as to obtain a final pH near 2. Vessel No. 1 serves as a control and receives neither vanadium nor acid. At the end of an additional 2 hours the reaction mixture is filtered and the pulp washed with water and tested to determine its G.E. brightness.

The proportion of vanadium (as metal) present in each vessel and the brightness of the pulps obtained in each vessel are shown in Table 1 below.

TABLE 1

| Vessel No. | Proportion Vanadium Added % Based on $ClO_2$ | G. E. Brightness |
|---|---|---|
| 1 (control) | — | 67.1 |
| 2 | 0.2 | 71.9 |
| 3 | 0.4 | 72.5 |
| 4 | 0.6 | 74.9 |
| 5 | 0.8 | 73.3 |
| 6 | 1.0 | 74.6 |

The above table shows that the brightness level of the pulp obtained for a given unit of chlorine dioxide application is considerably improved in the presence of a vanadium compound.

Similarly, following the above procedure but replacing the sodium vanadate as used therein with an equal proportion of vanadium pentoxide, vanadyl trichloride or vanadyl sulfate, an improvement of brightness level is observed.

EXAMPLE 2

Two series of appropriate reaction vessels are arranged. The first series will be referred to hereinafter as Series A and the second series will be referred to hereinafter as Series B. Each series consists of seven reaction vessels to which are charged equal portions of a mill chlorinated and extracted pulp. To the vessels of Series B there is added 0.008% of vanadium (based on the weight of pulp) in the form of sodium vanadate solution. Each of the pulps in both series is heated to circa 70° C. and to each is added 0.8% chlorine dioxide and 0.13% chlorine (based on the weight of pulp). The final consistency is 10%. The vessels are maintained at 70° C. for the entire reaction period. One vessel from each series is opened at the expiration of the reaction times shown in Table 2 below. The pulps are then washed with water and the brightness is measured.

Table 2

| Time Following Application of $ClO_2$ in Minutes | G. E. Brightness Series A (Control) | Series B |
|---|---|---|
| 5 | 50.4 | 52.1 |
| 10 | 53.3 | 55.4 |
| 15 | 55.7 | 55.9 |
| 30 | 57.2 | 56.9 |
| 60 | 56.3 | 58.0 |
| 180 | 55.3 | 61.5 |
| 300 | 53.2 | 62.1 |

It is clear from the above Table 2 that the series of bleachings carried out in the presence of vanadium (Series B) obtained a higher brightness level than the corresponding series wherein chlorine dioxide bleaching was carried out in the absence of the vanadium. It will also be observed from Table 2 that when the bleaching is carried out without vanadium being present, maximum brightness is reached in 30 minutes and thereafter decreases. In the Series B bleachings carried out in the presence of vanadium the G. E. brightness continues to improve up to at least 5 hours. This results in inhibition of brightness reversion in the bleached pulp after consumption of chlorine dioxide.

EXAMPLE 3

Two series of reaction vessels, hereinafter referred to as Series C and Series D respectively, are arranged. Each series consists of eight reaction vessels. Each vessel is charged with an equal proportion of a chlorinated and extracted pulp. Varying amounts of 0.1 N NaOH are added to the vessels to adjust the final pH of the bleach mixtures. Some of the reaction vessels are heated so as to warm the pulp contained therein to a temperature of 70° C. Others of the series are heated so as to warm the pulp contained therein to a temperature of circa 80° C. To the reaction vessels of Series D, there is added 0.008% of vanadium in the form of sodium vanadate and based on the weight of pulp. Series C is a control and does not receive a proportion of vanadium. To each vessel there is then added 0.8% of chlorine dioxide and 0.13% $Cl_2$ (based upon weight of pulp) with mixing. The reaction vessels are then maintained at the stated temperatures for a period of about three hours. At the end of this time, the pH of the resulting mixture is measured and a G. E. brightness level obtained for each reaction mixture. The results are shown in Table 3 below.

Table 3

| Temperature | Final pH | G. E. Brightness Series C (Control) | Series D |
|---|---|---|---|
| 70° C | 1.9 | 56.0 | 62.1 |
| 70° C | 2.6 | 60.2 | 61.5 |
| 70° C | 3.5 | 62.1 | 62.7 |
| 70° C | 4.5 | 65.2 | 66.6 |
| 70° C | 6.4 | 60.2 | 65.2 |
| 80° C | 1.9 | 55.6 | 64.8 |
| 80° C | 2.8 | 60.4 | 65.3 |
| 80° C | 4.2 | 66.9 | 63.8 |

It will be readily observed from Table 3 that the presence of vanadium is most effective at the lower pH ranges and is more effective at the higher temperature range.

What is claimed is:

1. A process for the delignification and bleaching of cellulosic pulp fibers which comprises; the step of mixing said pulp fibers with chlorine dioxide in the presence of a vanadium compound containing vanadium in the +4 or +5 oxidation state so as to provide a final pH in the mixture of less than about 3.0 whereby brightness reversion of resultant bleached and delignified pulp fibers is inhibited after consumption of chlorine dioxide.

2. The process of claim 1 wherein said vanadium compound is mixed with the pulp fibers prior to admixture of the chlorine dioxide with the pulp fibers.

3. The process of claim 1 wherein the proportion of vanadium present is within the range of from about 0.1 to about 2% by weight of chlorine dioxide.

4. The process of claim 1 wherein the proportion of vanadium is within the range of from about 0.5 to about 1% by weight of chlorine dioxide.

5. The process of claim 1 wherein said step is carried out so as to provide a final pH in the mixture within the range of from about 1.5 to about 2.5.

6. The process of claim 1 wherein said step is carried out at a temperature within the range of from about 70° C to about 80° C.

7. The process of claim 1 wherein said step is carried out at 70° C.

8. The process of claim 1 wherein the vanadium compound is mixed with the pulp fibers after admixture of the chlorine dioxide with the pulp fibers.

* * * * *